US006022021A

United States Patent [19]

Ku

[11] Patent Number: 6,022,021

[45] Date of Patent: Feb. 8, 2000

[54] ENTERTAINMENT DEVICE

[76] Inventor: Heng-Chun Ku, No. 22, Lane 117, Chunghsiao Road, Ping-Cheng, Tao Yuan Hsien, Taiwan

[21] Appl. No.: 09/118,091

[22] Filed: Jul. 17, 1998

[51] Int. Cl.[7] ..... A63F 9/08

[52] U.S. Cl. ..... 273/153 S; 273/155

[58] Field of Search ..... 273/153 R, 153 S, 273/155, 157 R

[56] References Cited

U.S. PATENT DOCUMENTS

| | | | |
|---|---|---|---|
| 4,415,158 | 11/1983 | Engel | 273/155 |
| 4,580,783 | 4/1986 | Cohan | 273/155 |
| 4,978,126 | 12/1990 | Morosow et al. | 273/155 |
| 5,135,225 | 8/1992 | Pszotka et al. | 273/155 |

FOREIGN PATENT DOCUMENTS

| | | | |
|---|---|---|---|
| 4134718 | 4/1993 | Germany | 273/155 |
| 2117256 | 10/1983 | United Kingdom | 273/155 |
| 2199755 | 7/1988 | United Kingdom | 273/155 |

*Primary Examiner*—Steven Wong
*Attorney, Agent, or Firm*—Bacon & Thomas, PLLC

[57] ABSTRACT

An entertainment device includes at least three sets of six movable elements and each of the elements of each of the sets is substantially in the form of a regular triangle. The elements of different sets are differently colored or marked. The six elements of each set are arranged around a primary center point of the set and defining a circumscribed circle. The center points of the three sets are arranged to define an auxiliary regular triangle with the circumscribed circles thereof tangential to each other. The auxiliary regular triangle has a center which defines a secondary center point surrounded by six of the elements that are from the sets associated with the auxiliary angle so that each of the primary center points and the secondary center point has six of such movable elements surrounding it. Each of the center point also has a driving mechanism associated therewith, which includes a rotating knob manually operable to rotate the driving mechanism about the associated center point and a coupling member which selectively couples the six associated elements to the rotating knob so as to allow the elements to be selectively moved along a circular path around the associated center point. By selectively rotating the driving mechanism of the center points, the movable elements which may be randomly positioned in different sets may be switched between different sets and eventually achieve a desired result.

17 Claims, 9 Drawing Sheets

ENTERTAINMENT DEVICE

FIELD OF THE INVENTION

The present invention relates generally to an entertainment device and in particular to an entertainment device which allows a player to rearrange the combinations of a plurality of movable elements in the form of groups or sets of six elements to achieve a desired result by rotating a plurality of manual rotating knobs.

BACKGROUND OF THE INVENTION

Intellectual entertainment toys are available in the market which require the players to play the "games" with their intelligence in order to achieve a desired result or to win the game. For example, the so-called "magic square" has been a very popular intellectual games for more than a decade, which comprises a cubic body having six faces each comprised of nine (three times three) square elements or blocks. The elements or blocks have different outside color and are movable between different faces of the cubic body by being rotated about a central join. The player moves the elements or blocks to achieve such a result that all the elements having the same color are moved to the same face of the cubic body.

Although the magic square is a very interesting toy, it is getting out of fashion. For many years, there has no new intellectual toy developed and the present invention is to provide a new intellectual toy.

SUMMARY OF THE INVENTION

Therefor, an object of the present invention is to provide an intellectual entertainment device.

Another object of the present invention is to provide an intellectual entertainment device which allows an unlimited expansion of the device so as to increase the complication and difficulty in playing the game.

To achieve the above objects, in accordance with the present invention, there is provided an entertainment device comprising at least three sets of six movable elements and each of the elements of each of the sets is substantially in the form of a regular triangle. The elements of different sets are differently colored or marked. The six elements of each set are arranged around a primary center point of the set and defining a circumscribed circle. The center points of the three sets are arranged to define an auxiliary regular triangle with the circumscribed circles thereof tangential to each other. The auxiliary regular triangle has a center which defines a secondary center point surrounded by six of the elements that are from the sets associated with the auxiliary angle so that each of the primary center points and the secondary center point has six of such movable elements surrounding it. Each of the center point also has a driving mechanism associated therewith, which comprises a rotating knob manually operable to rotate the driving mechanism about the associated center point and a coupling member which selectively couples the six associated elements to the rotating knob so as to allow the elements to be selectively moved along a circular path around the associated center point. By selectively rotating the driving mechanism of the center points, the movable elements which may be randomly positioned in different sets may be switched between different sets and eventually achieve a desired result.

BRIEF DESCRIPTION OF THE DRAWINGS

The present invention will be better understood from the following description of preferred embodiments thereof, with reference to the attached drawings, wherein.

DETAILED DESCRIPTION OF THE PREFERRED EMBODIMENT

Figure 1:
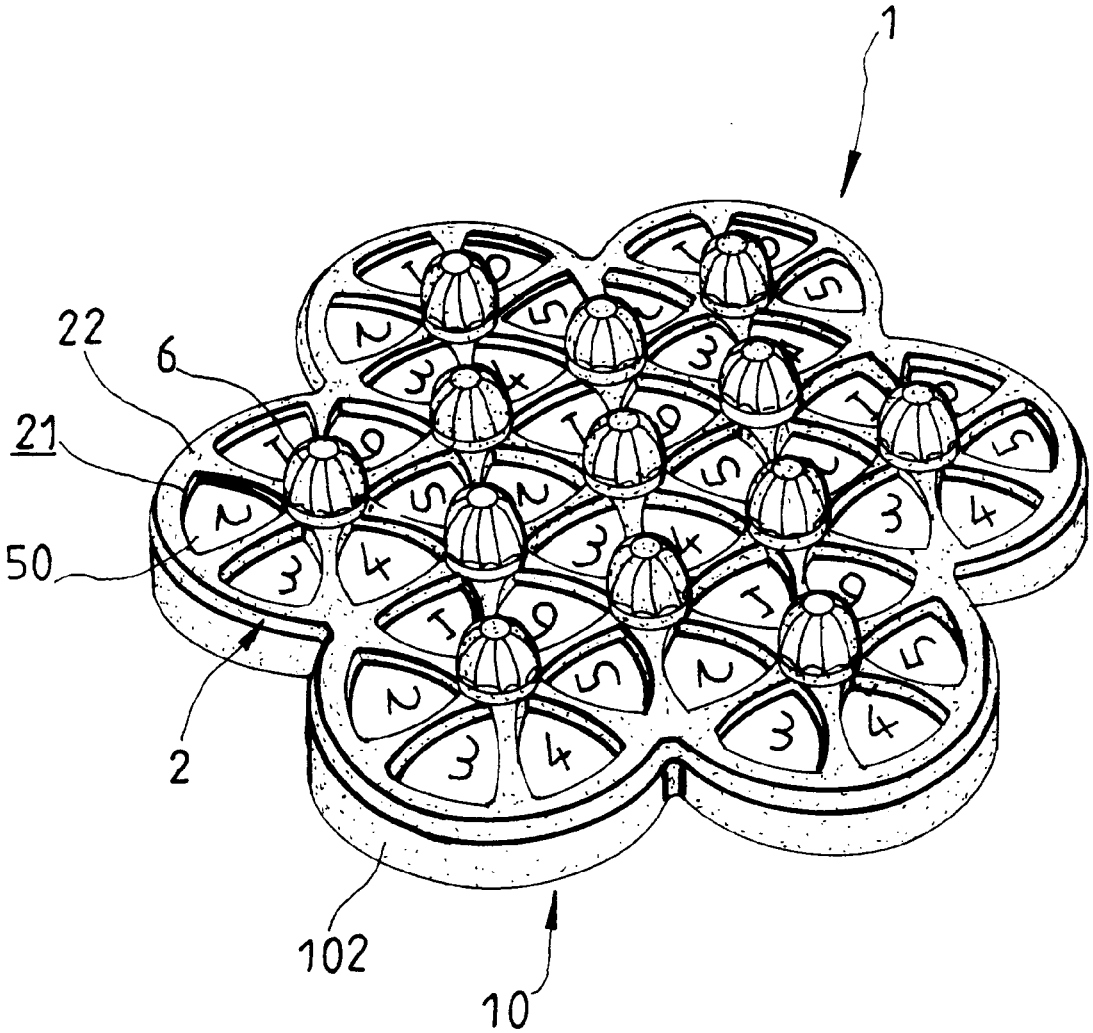
FIG. 1 is a perspective view showing an entertainment device in accordance with a preferred embodiment of the present invention which comprises seven sets of six movable elements.
Figure 4:
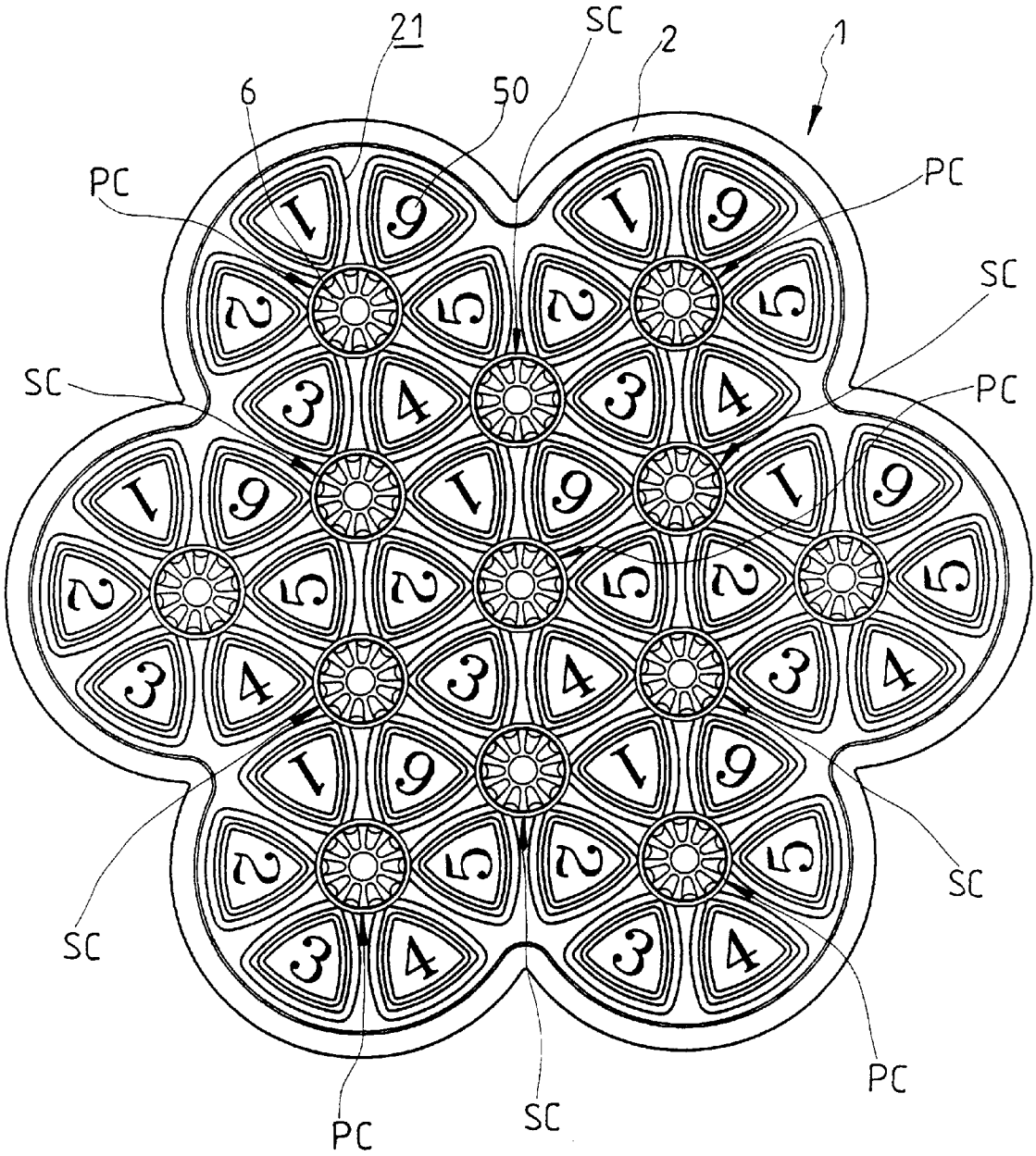
FIG. 4 is a top plan view of the entertainment device shown in FIG. 1.
Figure 6:
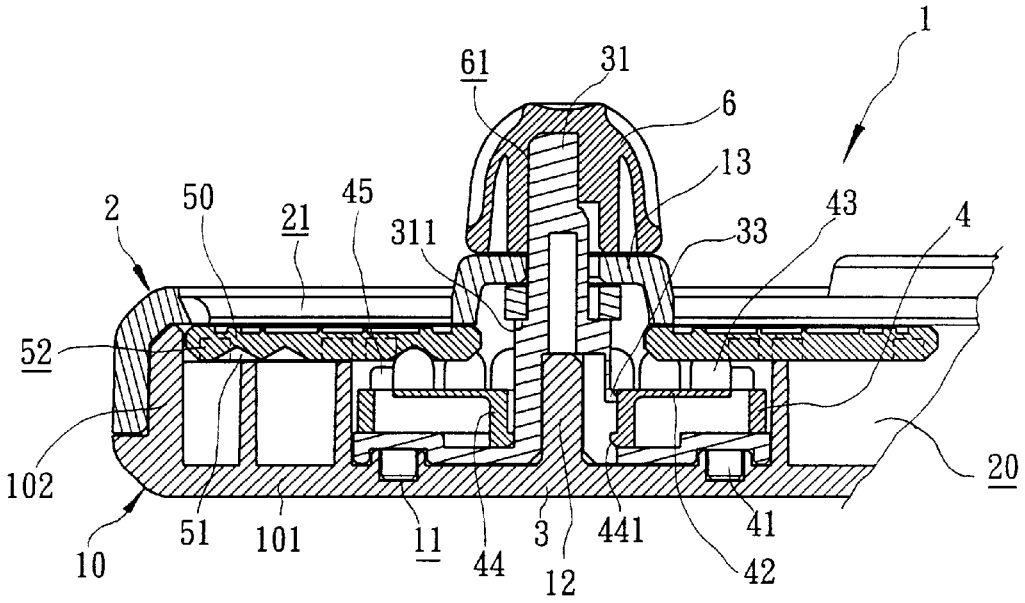
FIG. 6 is a cross-sectional view of a portion of the entertainment device showing the condition when the rotating knob of the driving mechanism is not actuated.
Figure 7:
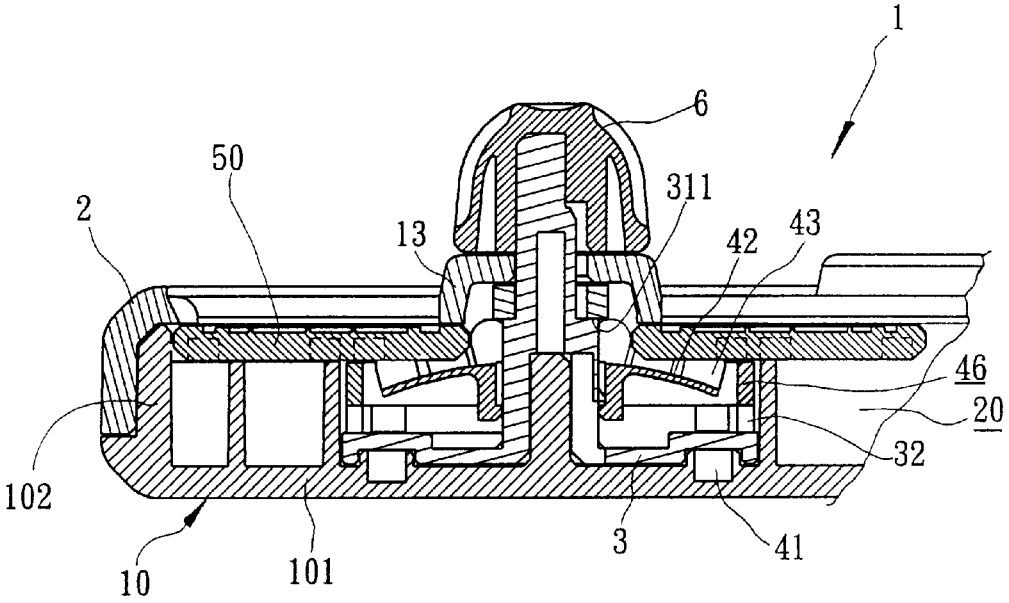
FIG. 7 is a cross-sectional view similar to FIG. 6, but showing the condition that the rotating knob is actuated and resilient arms are deflected to allow the movable elements to be moved.

With reference to the drawings and in particular to FIGS. 1 and 4, wherein an intellectual entertainment device constructed in accordance with a preferred embodiment of the present invention is shown, the entertainment device of the present invention comprises a substantially flat body 1 having a base 10 defined by a bottom 101 and surrounding side walls 102 (also see FIGS. 6 and 7) and a cover 2 positioned on and covering the base 10 to define therebetween an interior space 20 (see FIGS. 6 and 7). The cover 2 defines a plurality of sets of openings 21 on a top surface 22 thereof. In accordance with the present invention, each opening set comprises six openings 21 distributed around a common center point PC and each occupying an angle of approximately 60 degrees and substantially in the form of a regular triangle so that the six openings 21 of the set may be regarded as six regular triangles constituting a hexagon.

Figure 2:
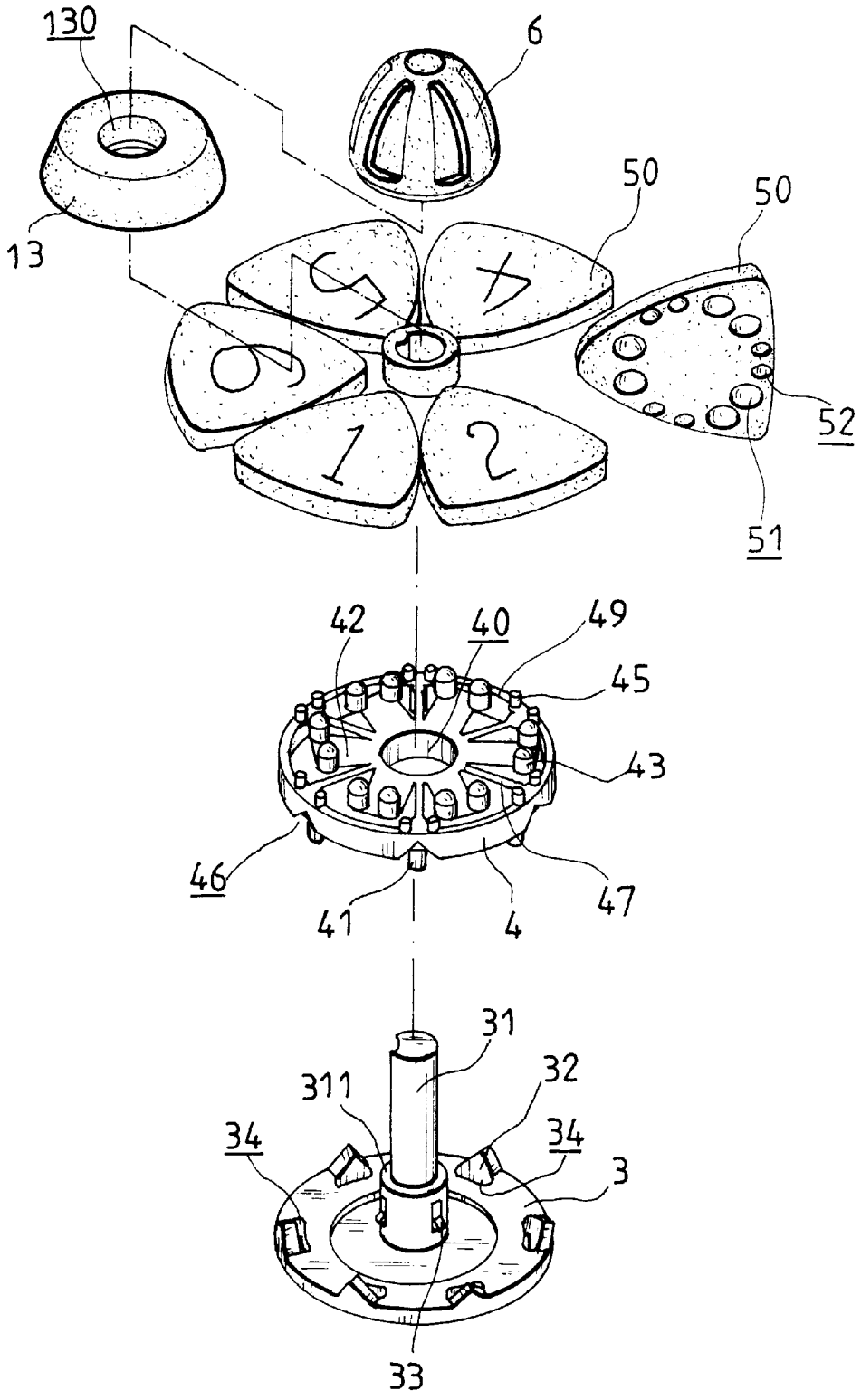
FIG. 2 is an exploded perspective view of the driving mechanism of each set of the movable elements together with the six movable elements.
Figure 3:
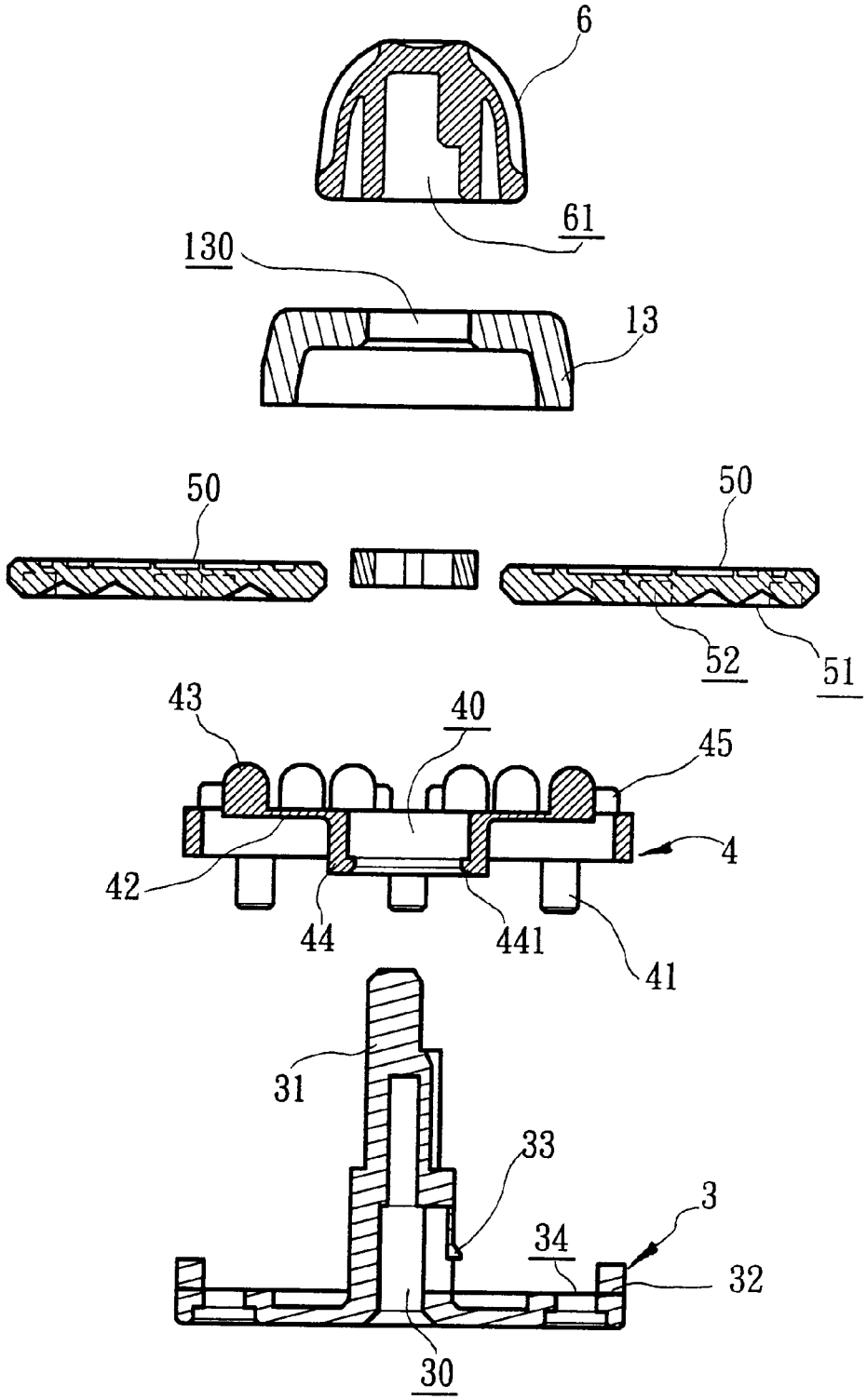
FIG. 3 is an exploded cross-sectional view of the driving mechanism shown in FIG. 2 as well as the movable elements.
Figure 3A:
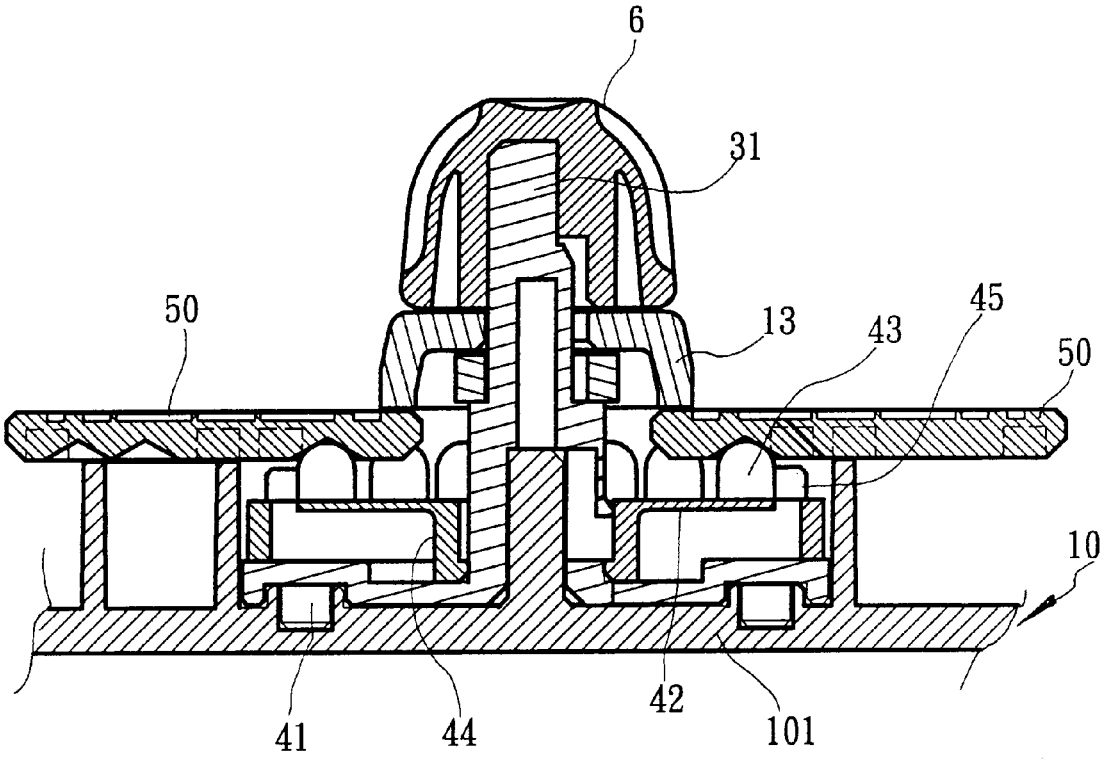
FIG. 3A is a cross-sectional view of the driving mechanism shown in FIG. 2 in an assembled condition.

Also referring to FIGS. 2, 3 and 3A, in accordance with the present invention, each of the openings 21 has a movable element 50 associated therewith which is movably disposed within the interior space 20 of the body 1 so that each opening set has six movable elements 50 associated therewith which define a unit or a set of movable elements. Thus each unit comprises six movable elements 50 arranged to surround the center point PC and define an imaginary circle that circumscribes the six movable elements 50 and centered at the center point PC.

In the embodiment illustrated, there are seven sets of the openings 21 and seven associated sets of movable elements 50, including a central set and six circumferential sets surrounding the central set. The sets are arranged in such a way that any three of them constitute an auxiliary regular triangle so that any two adjacent ones of the six openings 21 of the central set have a common connection point between the adjacent outer apexes thereof which defines a secondary center point SC that is located at the center of the auxiliary regular triangle defined between the central set and two associated circumferential sets. Due to the geometric feature of the hexagon, each of the secondary centers SC may also be regarded as having six openings 21 and the associated elements 50 surrounding it. In the following description, the central set and the six circumferential sets will also be referred as primary sets or primary units, while the secondary centers and the associated openings will be referred to as secondary set or secondary unit. (It should be noted that the secondary sets are in general comprised of portions of adjacent primary sets.)

Describing in a more generic way, the entertainment device of the present invention comprises at least three sets of six regular-triangular elements and each set defines a center point PC surrounded by the six elements 50 and a circumscribed circle surrounding the six elements 50. The center points PC of any three of the sets are arranged in the auxiliary regular triangle with the circumscribed circles tangential to each other. The center of the triangle defined by the center points of the three sets defines the secondary center point SC.

Each of the elements 50 has at most three center points PC or SC associated therewith, respectively at the three apexes thereof.

Figure 8:
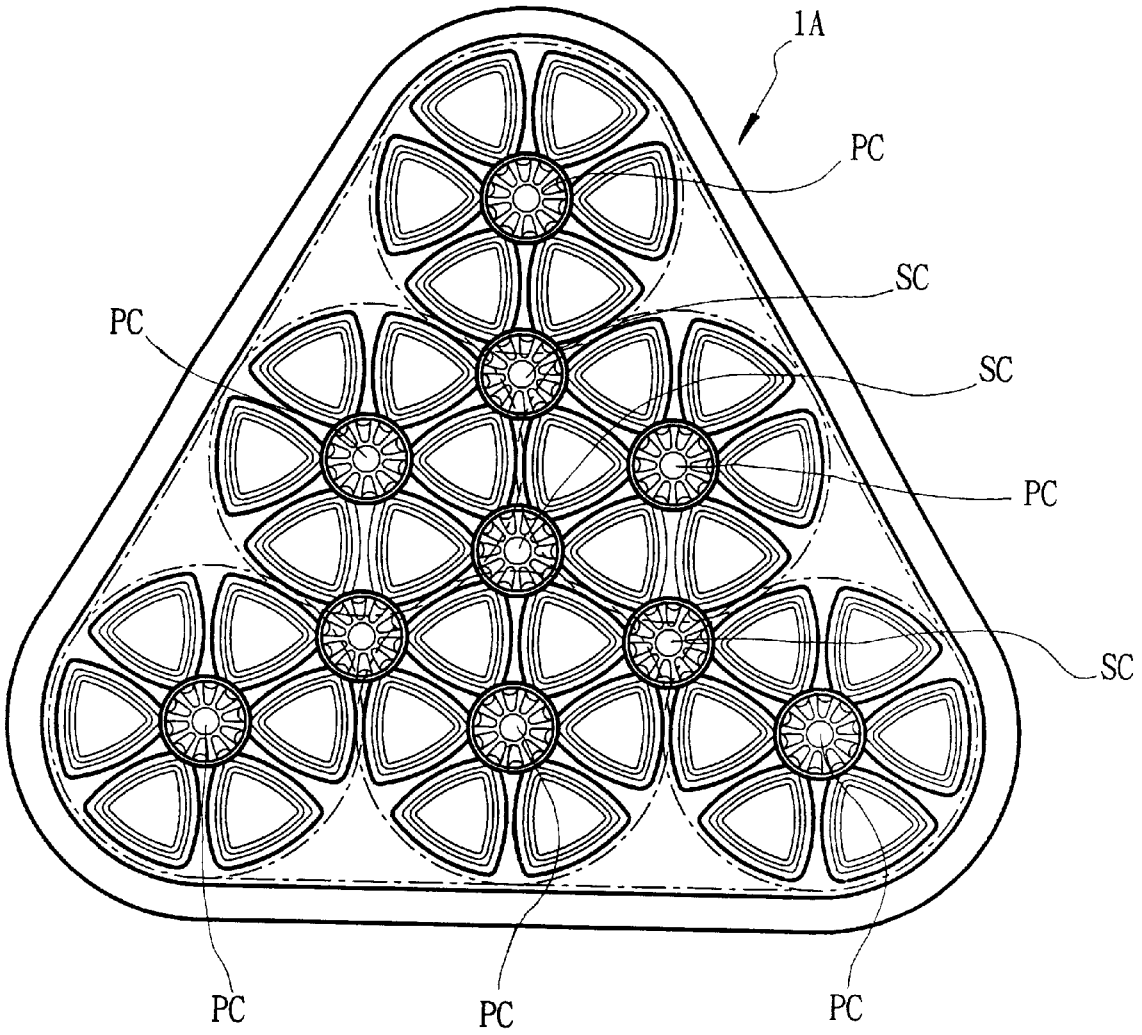
FIGS. 8 and 9 are top plan views showing two different embodiments of the present invention in which the entertainment device of the present invention comprises six and five sets of six movable elements.
Figure 9:
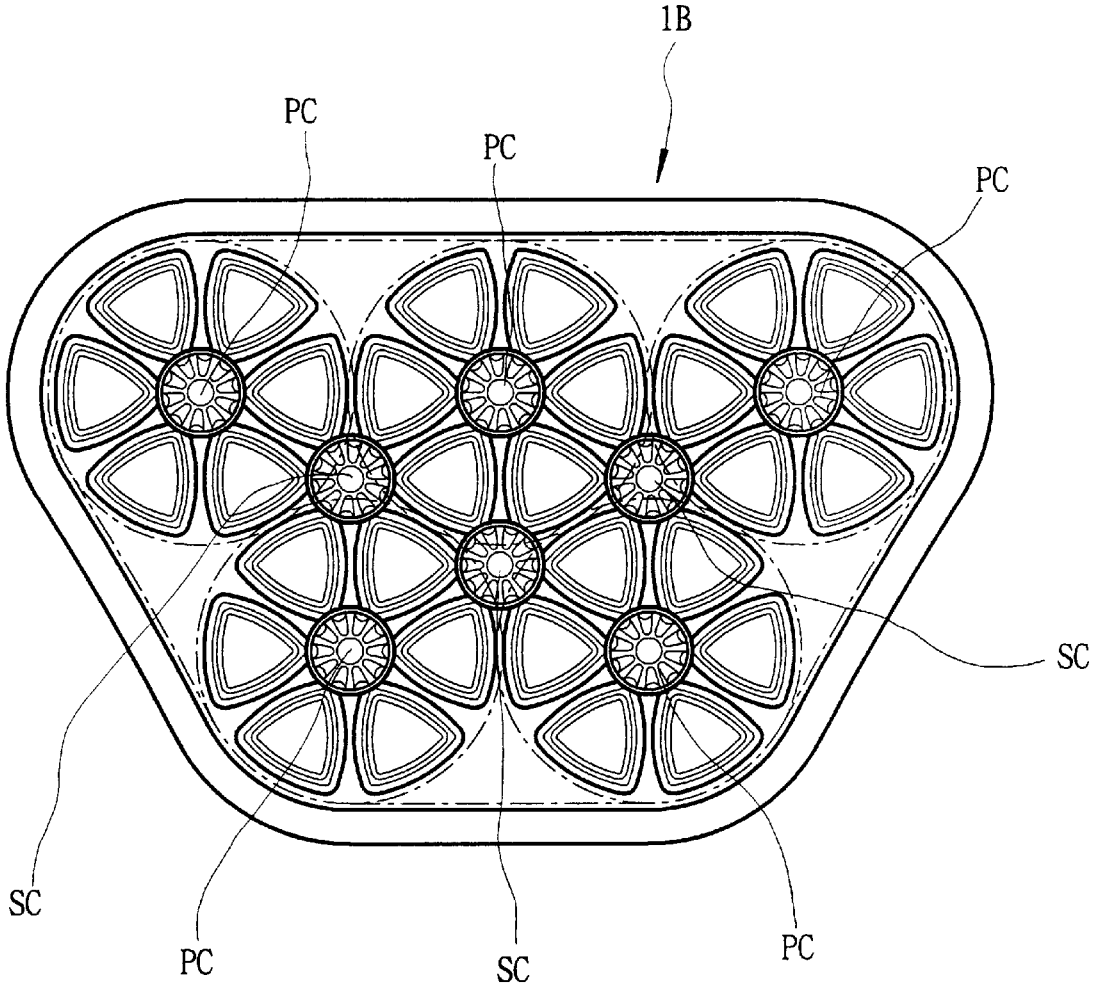

Quite obviously, the geometry may be unlimitedly expanded or reduced if desired by treating each of the six circumferential set as a central set. For example, FIGS. 8 and 9 respectively show different embodiments of the present invention, respectively designated with reference numerals 1A and 1B, in which the entertainment device of the present invention comprises six and five sets of the movable elements. For simplicity, the following description will be given basically based on the preferred embodiment illustrated in the drawings and the expansion will be apparent to those skilled in the art.

The center point PC or SC of each of the primary and secondary units has a driving device or mechanism associated therewith to allow a player to rotate the movable elements 50 about the center point PC or SC. The driving device of the secondary center point SC allows the movable elements 50 to be switched between two associated primary units and by doing so, all the elements 50 may be moved between any two sets by means of the driving devices of properly selected sets.

The driving device comprises a support pin 12 (see FIGS. 6 and 7) fixed to the bottom of the base 1 and extending upward therefrom toward the cover 2. The support pin 12 is located at the center point PC or SC of the primary or secondary unit associated with the driving device and defines a rotational axis of the driving device which is coincident with the center point PC or SC.

A driving disk 3 takes the form of a circular disk having a central axle 31 extending upward from an upper side or surface of the driving disk 3 and a blind hole 30 formed on a lower side of the driving disk 3 and extending substantially co-axially with the axle 31 to fit over the support pin 12 in the base 1 for positioning the driving device at the center point of the unit.

A control member 4 comprises a ring 49 and a hub 44 connected together with spokes 47 so as to define a plurality of partitioned spaces between the ring 49 and the hub 44 for accommodating therein a plurality of resilient arms 42 therein which radially extend from the hub 44, each being associated with one of the elements 50 of the unit associated with the driving device and having at least one (preferably two as shown in the drawings) anchoring pin 43 mounted thereto and extending upward therefrom. Preferably, the spokes 47 and the resilient arms 42 are arranged to alternate with each other. The resiliency of the alms 42 allows the arms 42 to deflect which causes the anchoring pins 43 to move substantially in a direction parallel with the axis of the driving device. The ring 49 has formed on an upper edge at least one (preferably two as shown in the drawings) driving pin 45 associated with each of the resilient arms 42, the driving pin 45 being fixed to the ring 49 and extending upward therefrom to be substantially parallel with the associated anchoring pin 43.

The hub 44 has a center bore 40 rotatably fit over the axle 31 of the driving disk 3 so as to have the ring 49 to be substantially co-axial with the driving disk 3 and the associated center point PC or SC. To prevent the control member 4 from disengaging from the axle 31 of the driving disk 3, the hub 44 is provided with inward projection 441 inside the central bore 40 and corresponding to the projection 441, the axle 31 is provided with at least one resilient barb 33 which is engageable the projection 441 of the hub 44 so as to limit the axial movement of the control ring 4 with respect to the driving disk 3.

The driving pins 45 that, in the embodiment illustrated, are provided on the ring 49 are arranged to be associated with each of the spokes 47. The ring 49 is to make the spokes 47 more rigid in resisting deflection. Thus, the ring 49 may be eliminated and the spokes 47 formed as cantilever arms similar the resilient arms 49 but having a great bending moment of inertia so that the spokes 47 are regarded as being rigid and incapable to deflect (thus the spokes 47 being also referred to as rigid arms hereinafter) with the driving pins 45 fixed on the spokes 47 in the proximity of the spokes 47. In this case, there would be six resilient arms 42 and six spokes (or rigid arms) 47 alternating each other.

The ring 49 also has a plurality of notches 46 formed on an lower edge thereof. Preferably, the notches 46 are equally spaced along the lower edge of the ring 49. Corresponding to the notches 46, the driving disk 3 has a plurality of projections 32 formed on the upper side thereof and receivable within the associated notches on the ring 49 when the control member 4 is fit over the axle 31 of the driving disk 3 and positioned on the upper side of the driving disk 3. In accordance with the present invention, the notches 46 and the projections 32 are configured to provide a camming engagement therebetween so that when a relative rotation occurs between the control member 4 and the driving disk 3, the camming engagement causes an upward force on the control member 4 which urges the control member 4 upward and away from the upper side of the driving disk 3.

In the embodiment illustrated, the notches 46 takes the form of a triangle having two opposite inclined faces. The projections 32 are also triangular in shape having two inclined sides and substantially complementary to the associated notches 46 so as to have the two inclined sides of the projection 32 in surface contact with the two inclined faces of the associated notch 46. Any rotation of the control member 4 relative to the driving disk 3 causes a sliding motion between one of the two inclined faces of the notch 46 and the associated inclined side of the projection 32 which urges the control member 4 upward and away from the driving disk 3.

The control member 4 also has a plurality of holding pins 41 formed on the lower side thereof and extending downward therefrom. Corresponding to the holding pins 41, the driving disk 3 has a plurality of elongated slots 34 formed thereon to receive the holding pins 41 to extend therethrough. The slots 34 has a circumferential length which allows the driving disk 3 and the control member 4 to rotate relative to each other to such an angular extent which allows the control member 4 to be moved away from the driving disk 3 a predetermined distance.

In an alternative embodiment, the slots 34 are replaced by circumferential cut-outs or notches formed on the driving disk 3.

The holding pins 41 has such a length which allows the pins 41 to extend through the associated slots 34 on the driving disk 3 and partially received within a corresponding holes 11 (see FIGS. 6 and 7) formed on the bottom of the base 1. The portion of the holding pins 41 that is received within the associated holes 11 is corresponding to or less than the predetermined distance that the control member 4 can be moved away from the driving disk 3. The operation is that the driving disk 3 is rotated while the control member 4 is positioned on the upper side of the driving disk 3 and the holding pins 41 are received within the holes 11 of the base 1 which temporarily prevents the control member 4 from rotation. The rotation of the driving disk 3 eventually causes the control member 4 to move, in the upward direction, the predetermined distance away from the driving disk 3 due to the camming engagement between the notches 46 of the control member 4 and the driving disk 3. The holding pins 41 are thus withdrawn out of the holes 11 and the holding pins 41 are then moved circumferentially relative to the slots 34 of the driving disk 3 due to the relative rotation and brought into contact engagement with the circumferential ends of the slots 34 so that further rotating the driving disk 3 drives the control member 4 to rotate in unison therewith with the control member 4 separated from the driving disk 3.

The resiliency of the resilient arms 42 helps springing the control member 4 back into disposition on the driving disk 3 when the control member 4 is rotated 60 degrees or an integer multiple of 60 degrees which moves the elements 50 to the previous positions of the next elements 50.

Figure 5:
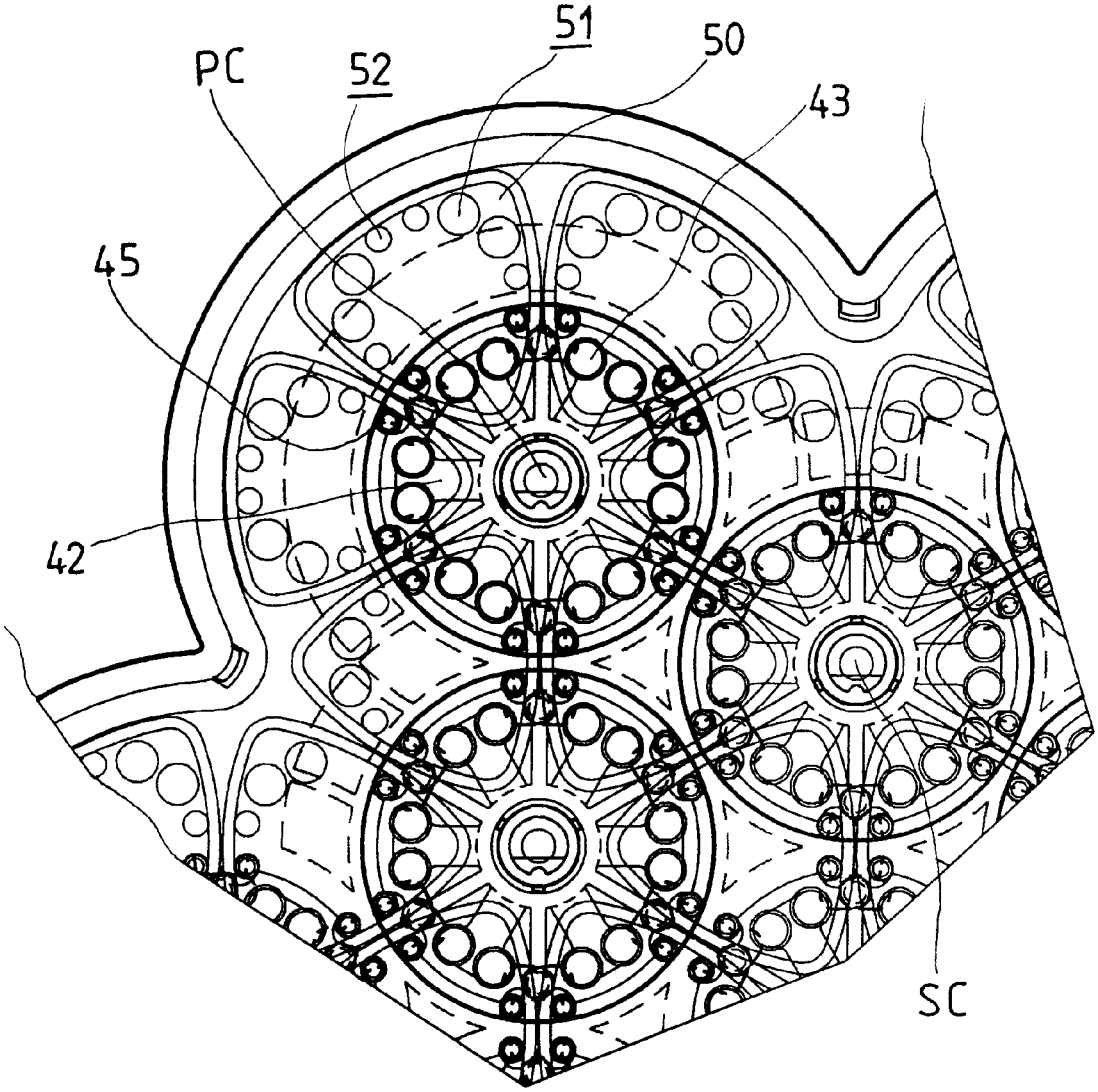
FIG. 5 is a schematic view of a portion of the entertainment device of the present invention showing the spatial relationship between the movable elements and the associated three center points.

Each of the triangular elements 50 of the set is associated with one of the resilient arms 42 and the associated rigid arms 47. Each of the elements 50 has formed on an underside three groups of recesses to be respectively associated with the at most three center point associated with the element, each groups comprising at least one cavity 51 corresponding in position and number to the anchoring pin 43 of the associated resilient arm 42 and at least one hole 52 corresponding in position and number to the driving pin 45 of the rigid arm 47. In the embodiment illustrated, there are two such cavities 51 and two such holes 52. As can be seen from drawings 1, 4 and 5 and described above, each of the element 50 may be at most associated with three of the units of the device so that the three groups of recesses are respectively associated with the three units. FIG. 5 particularly shows the condition.

The cavity 51 and the anchoring pin 43 and the hole 52 and the driving pin 45 have such sizes that the element 50 is supported on the control member 4 by means of contact engagement between a top end of the anchoring pin 43 that is received within the cavity 51 and a bottom of the cavity 5 1with the driving pin 45 being located outside and not engaged with the hole 52.

The anchoring pin 43 that is received within the cavity 51 of the element 50 serves to hold the element 50 in position with respect to the center point of the unit, see FIGS. 6 and 3A.

The upward movement of the control member 4 caused by the relative rotation between the control member 4 and the driving disk 3 (through the camming engagement between the triangular projections 32 of the driving disk 3 and the notches 46 of the control member 4) applies a force to the resilient arm 42 by means of the contact engagement between the top end of the anchoring pin 43 and the cavity 51 which deflects the resilient arm 42 and allows the driving pin 45 to get into the holes 52 (see FIG. 7). Thus, when the relative rotation of the driving disk 3 with respect to the control member 4 eventually rotate the control member 4 in unison therewith, the control member 3, with the driving pin 45 received within the hole 52 of the element 50, drives the element 50 to follow the driving disk 3.

In accordance with the present invention, the cavity 51 and the top end of the associated anchoring pin 43 are configured to provide a camming action therebetween so that when one of the three units is actuated to rotate, while the remaining two units are not, the camming action of the element 50 associated with said remaining two units allows the element 50 to be disengaged from the anchoring pins 45 of said remaining two units and moved by said one unit by having the hole 52 associated with said one unit engaged by the driving pin 45 of the associated rigid arm 47 of said one unit. For example, the top end of the anchoring pin 43 may be rounded and the cavity 51 has a conic configuration as shown in the drawings.

The axle 31 of the driving disk 3 has such a length that extends higher than the elements 50 and projects out of a corresponding hole formed on the top surface 22 of the cover 2 so as to allow a cap 6 having a bore 61 to forcibly fit thereon. The cap 6 partially prevents the cover 2 from separating from the base 1 and thus helps holding the driving disk 3, the control member 4 and the triangular elements 40 in position inside the interior space 20 between the base 1 and the cover 2.

The engagement between the cap 6 and the axle 31 of the driving disk 3 is such that they are rotatable in unison with each other so as to allow the player to rotate the driving disk 3 via the cap 6. In this respect, the cap 6 may be provided with ribs on the outside surface thereof.

If desired, a holding ring 13 having a central bore 130 sized to rotatably fit over the axle 31 is provided and positioned on the elements 50 to be in contact with the inner apex of each of the elements 50. This helps holding the elements 50 in position. A shoulder 311 may be provided on the axle 31 to support the holding ring 13.

Although the preferred embodiment has been described to illustrate the present invention, it is apparent that changes and modifications in the specifically described embodiments can be carried out without departing from the scope of the present invention which is intended to be limited only by the appended claims.

What is claimed is:

1. An entertainment device comprising at least of three sets of six movable elements, each of the elements of each of the sets being substantially in the form of a regular triangle arranged around a common primary center point and defining a circle circumscribing the six elements, the primary center points of the three sets being arranged to define an auxiliary regular triangle with the circumscribed circles thereof tangential to each other, the auxiliary regular triangle having a center which defines a secondary center point so that each of the primary center points and the secondary center point having six of such movable elements surrounding the center point, each of the center points also having driving means associated therewith, the driving means comprising a manual rotating knob manually operable to rotate the driving means about the associated center point, the driving means comprising coupling means which selectively couples the six associated elements to the rotating knob so as to allow the elements to be selectively moved along a circular path around the center point; and wherein the entertainment device comprises a base and wherein the driving means comprises a disk having a central axle fixed to the manual rotating knob, the disk being rotatably supported on the base with the axle coincident with the associated center point, the coupling means comprises a hub defining a central bore rotatably fit over the axle and coupled to the disk so as to be rotatable therewith, the coupling means having six rigid arms extending radially from the hub and arranged in a substantially angularly equally spaced manner around the hub, each of the rigid arms having at least one driving pin mounted thereon, the six elements associated with the center point being respectively positioned above the rigid arms and having formed thereon, associated with each of the sets, at least one hole corresponding to the driving pin of the associated rigid arm, separation means being provided to separate the elements from the rigid arms and the separation means being collapsible to allow the driving pins to be received within and engaged by the holes of the respective elements when the driving means is rotated by the rotating knob to rotate the coupling means which in turn drives the elements via the engagement between the driving pin and the hole of the element along the circular path.

2. The entertainment device as claimed in claim 1, wherein the separation means comprises a plurality of resilient arms associated with the elements and radially extending from the hub of the coupling means and deflectable to have a free end of the resilient arm movable with respect to the hub in a direction substantially parallel with the hub, each of the resilient arms having at least one anchoring pin mounted on the free end thereof receivable within at least one cavity formed on the respective element so as to support the element above the associated rigid arm, the anchoring pin having a length sufficient to separate the driving pin of the associated rigid arm from the hole of the element, but allowing the driving pin to get into the hole when a force is applied to the resilient arm to deflect the resilient arm.

3. The entertainment device as claimed in claim 1, wherein the coupling between the coupling means and the disk comprises a plurality of pins extending from the hub and received within corresponding slots formed on the disk so as to rotatably couple the coupling means to the disk.

4. The entertainment device as claimed in claim 2, wherein the hub of the coupling means is linearly movable with respect to the axle of the disk within a predetermined distance and wherein the driving means further comprises urging means which urges the coupling means relative to the axle toward the elements so as to apply the force to the resilient arms to deflect the resilient arms.

5. The entertainment device as claimed in claim 4, wherein the hub is fit over the axle of the disk in such a way to allow the hub to be relative rotatable to the disk for a predetermined angular displacement and then rotatably fixed thereto and wherein the urging means comprises a plurality of projections formed on the disk and a plurality of notches formed on the hub to respectively receive the projections therein, each of the notches and the associated projection being provided with a camming engagement therebetween which converts the relative rotational movement between the hub and the disk into an linear movement of the hub relative to elements so as to apply the force to the resilient arms.

6. The entertainment device as claimed in claim 5, wherein the camming engagement comprises a triangular shape provided on each of the projections and a corresponding configuration of the respective notch.

7. The entertainment device as claimed in claim 5, wherein the coupling between the coupling means and the disk comprises a plurality of pins extending from the hub and received within corresponding slots formed on the disk, the slots being circumferentially elongated having circumferential ends so as to allow the pins to circumferentially move relative thereto within the predetermined angular range and then rotatably fix to the disk when the pin reaches the circumferential ends, the base of the device having a hole corresponding to each of the pins that extends from the hub and through the elongated slot on the disk so that when the disk is rotated relative to the hub within the predetermined angular range, the hub is held stationary by means of the pins received within the holes on the base.

8. The entertainment device as claimed in claim 1, further comprising a cover mounted on the base to define therebetween an interior space for accommodating the driving means and the movable elements, the cover being provided with openings to partially expose each of the movable elements and further openings to allow the axles of the disks of the driving means to extend therethrough to be fixed to the manual rotating knob.

9. The entertainment device as claimed in claim 2, wherein the anchoring pin and the cavity of the element are configured to provide a camming action there between when the element is driven to move relative to the anchoring pin so as to allow the element to separate from the anchoring pin.

10. The entertainment device as claimed in claim 9, wherein the cavity has a configuration of a cone and the anchoring pin has a round top end received within the conical cavity.

11. The entertainment device as claimed in claim 4, wherein the axle of the disk comprises retention means to prevent the hub of the coupling means from disengaging from the axle.

12. The entertainment device as claimed in claim 11, wherein the retention means comprises at least one barb provided on the axle and an inward projection formed on an inside surface of the central bore of the hub which is engageable with the barb to prevent the separation of the hub from the axle and to define the predetermined distance of linear movement of the hub relative to the axle.

13. The entertainment device as claimed in claim 1, wherein the entertainment device comprises seven sets of movable elements, the seven sets being arranged to have six of the seven sets surrounding a central set.

14. The entertainment device as claimed in claim 1, wherein the entertainment device comprises six sets of movable elements, the six sets being arranged to form a regular triangle.

15. The entertainment device as claimed in claim 1, wherein the entertainment device comprises five sets of movable elements, the five sets being arranged to form a trapezium having two of the five sets in one row and the remaining three sets in a second row, the two rows juxtaposing each other and the sets being arranged alternately.

16. The entertainment device as claimed in claim 1, wherein each of the rigid arms of the coupling means has two driving pins.

17. The entertainment device as claimed in claim 2, wherein each of the resilient arms has two anchoring pins formed thereon.

* * * * *